US008186941B2

(12) United States Patent
Lai

(10) Patent No.: US 8,186,941 B2
(45) Date of Patent: May 29, 2012

(54) SWING STRUCTURE FOR A CEILING FAN

(75) Inventor: Huo-Cheng Lai, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 1062 days.

(21) Appl. No.: 12/052,441

(22) Filed: Mar. 20, 2008

(65) Prior Publication Data

US 2009/0238690 A1 Sep. 24, 2009

(51) Int. Cl.
*F01D 25/24* (2006.01)

(52) U.S. Cl. ..... 415/126; 417/360; 417/423.15

(58) Field of Classification Search ..... 415/126; 416/59, 148, 102, 117, 118; 417/423.15, 417/424.1

See application file for complete search history.

(56) References Cited

U.S. PATENT DOCUMENTS 1,354,098 A * 9/1920 Glasser ..... 310/40.5
2,123,448 A * 7/1938 Weber ..... 416/246
5,522,704 A * 6/1996 Casteel ..... 416/246
6,817,830 B1 * 11/2004 Chen ..... 415/60
7,594,798 B1 * 9/2009 Bucher et al. ..... 416/100
2003/0082062 A1 * 5/2003 Chen ..... 417/423.5
2004/0191066 A1 * 9/2004 Chen ..... 416/210 R

* cited by examiner

*Primary Examiner* — Edward Look
*Assistant Examiner* — Adam W Brown
(74) *Attorney, Agent, or Firm* — Ming Chow; Sinorica, LLC

(57) ABSTRACT

A swing structure for a ceiling fan includes a reduction motor disposed with a driving wheel having its center fixed with a connecting rod. An intermediate aluminum ring is mounted on the outer circumference of the weight center of a fan motor, having a swing spindle provided with at least one first bearing, and a threading spindle disposed at the other end set therein with a second bearing. The swing spindle has one end connected with the connecting rod. The swing velocity of the ceiling fan is controlled by the reduction motor not affected by different rotating velocities of the fan motor. A hanging tube has its lower ends respectively fixed with the swing spindle and the threading spindle and its upper end secured on a support base, enabling a ceiling fan in stalled at different angles and still able to swing smoothly.

7 Claims, 7 Drawing Sheets

(a)

(b)

(a)

(b)

(a)

(b)

(a)

(b)

(a)

(b)

SWING STRUCTURE FOR A CEILING FAN

BACKGROUND OF THE INVENTION

1. Field of the Invention

This invention relates to a swing structure for a ceiling fan, particularly to one provided with a reduction motor for controlling and stabilizing swing velocity of a ceiling fan.

2. Description of the Prior Art

Generally, ceiling fans or roof fans or wall fans are not designed to swing rightward and leftward because swing motion of a fan is carried out by a gear unit installed at the rear side of a fan motor and the gear unit may produce slippage or disengagement if the ceiling fan is overweight or used for a long period of time. In addition, if a swing pull handle is provided exposed to the outside, it will spoil the external features of the fan, and since a ceiling fan or a roof fan has only one single side fixed stably, the fixing frame of the ceiling fan is prone to become loosened and unstable soon. As for a multiple-rotor ceiling fan, it has two or more units of fans pivotally assembled at the outer ends of a hanging base for producing multi-direction or radial wind blowing. Although the multiple-rotor ceiling fan has better effect in blowing and air current circulation than the conventional one, yet each fan is stationary in its angle when the ceiling fan is operated; therefore, the multiple-rotor ceiling fan can only produce partial blowing and air current circulation. In case of changing blowing angles of the ceiling fan, an angle-fixing member has to be employed manually for adjusting and fixing the angles of each fan, thus taking a lot of exertion and time.

SUMMARY OF THE INVENTION

The objective of this invention is to offer a swing structure for a ceiling fan, which is fixed on a fan motor. The swing structure includes a reduction motor having one side pivotally disposed with a driving wheel having its center fixed with one end of a connecting rod. An intermediate aluminum ring is mounted around the outer circumference of the weight center of the fan motor and has one end provided with a swing spindle fitted thereon with a first three-way tube having at least one first bearing set therein, and the other end disposed with a threading spindle fitted thereon with a second three-way tube having at least one second bearing installed therein. The swing spindle has one end connected with the connecting rod. A hanging tube has its lower opposite ends respectively fitted and secured in the first and the second three-way tube and its upper end fixed on at least one support base, which enables a ceiling fan to be installed at different locations of preset angles.

The support base makes it possible to hang the fan at a preset location, and the threading spindle is provided for an electric wire to be inserted into the intermediate aluminum ring through the second three-way tube and hidden therein. By so designing, the swing velocity of the ceiling fan is controlled by the reduction motor not affected by different rotating velocities of the fan motor, and the electric fan can be positioned at different angles and still can swing rightward and leftward.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
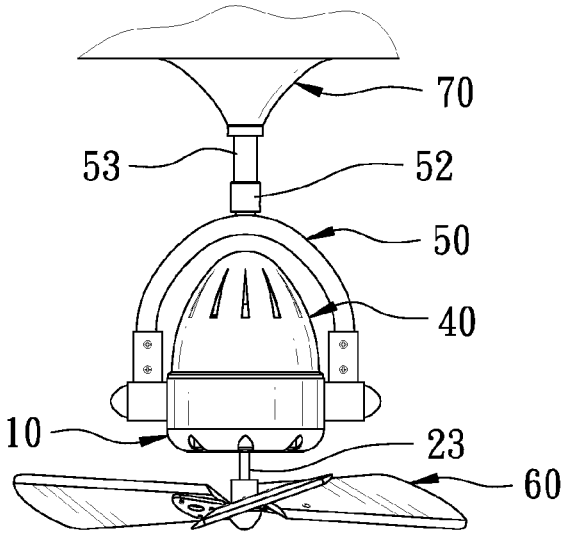
FIGS. 1(*a*) and 1(*b*) are a front view and a side view of a first preferred embodiment of a swing structure for a ceiling fan in the present invention.
Figure 1:
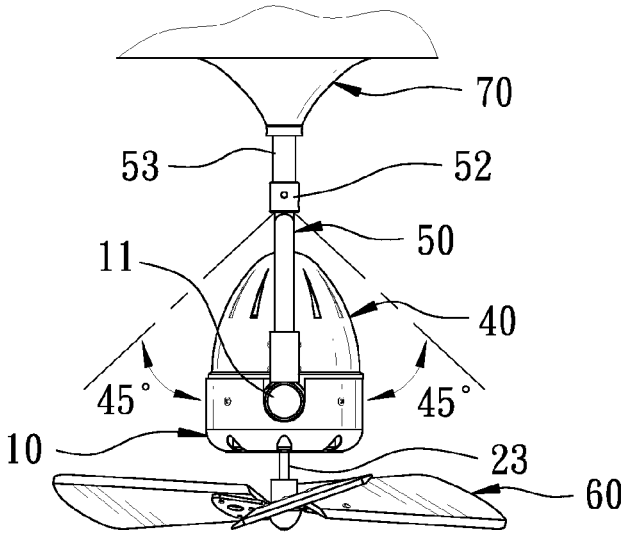

A first preferred embodiment of a swing structure for a ceiling fan in the present invention, as shown in FIGS. 1(*a*), 1(*b*) and 2, includes a front cover 10, a swing mechanism 20, an intermediate aluminum ring 30, a rear cover 40 and a hanging tube 50 as main components combined together.

The front cover base 10 is shaped like a ring, having its right and left side respectively cut with a first U-shaped notch 11 and a second U-shaped notch 12 respectively formed with an upward opening.

Figure 3:
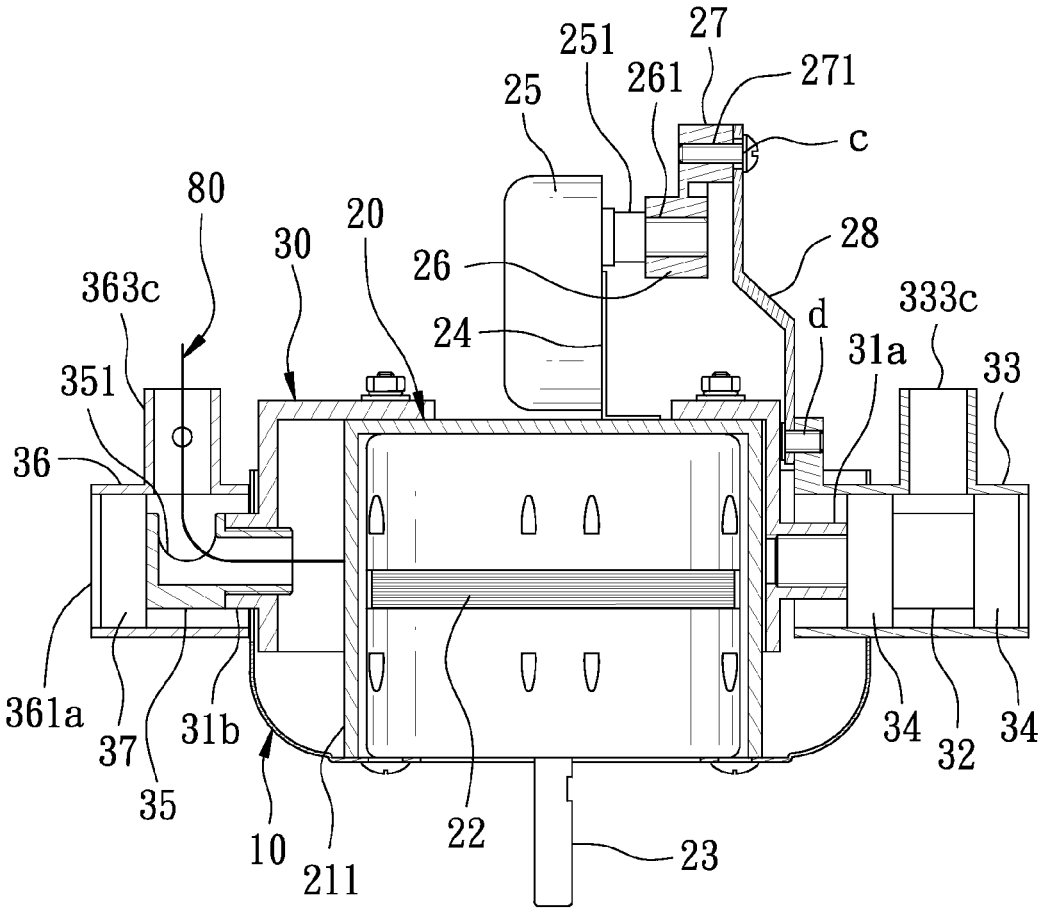
FIG. 3 is a cross-sectional view of the first preferred embodiment of the swing structure for a ceiling fan in the present invention.

The swing mechanism 20, referring to FIG. 3, is received in the interior of the front cover base 10 and has its lower end secured with the bottom of the front cover base 10. The swing mechanism 20 consists of a fan motor 21 having its intermediate outer circumference wound thereon with several rounds of coils 22 and its lower end fixed with a main shaft 23 aligned to an axis (a) to be inserted through the front cover base 10 for pivotally assembling a fan blade 60 thereon. The fan motor 21 has its outer circumference disposed with an outer casing 211 having a downward opening and having its lower outer circumference combined with the front cover base 10. Further, the outer casing 211 of the fan motor 21 has its top end fixed with the bottom of an L-shaped plate fixing base 24, which has one side installed with a reduction motor 25 having its rotating shaft 251 secured on the fixing base 24. The fixing base 24 has another side provided with a driving wheel 26 having its axis 261 fixed on the rotating shaft 251 and having one side circumference connected with an actuating wheel 27 having the outer side of its axis 271 axially and pivotally connected with one end of a connecting rod 28.

Figure 2:
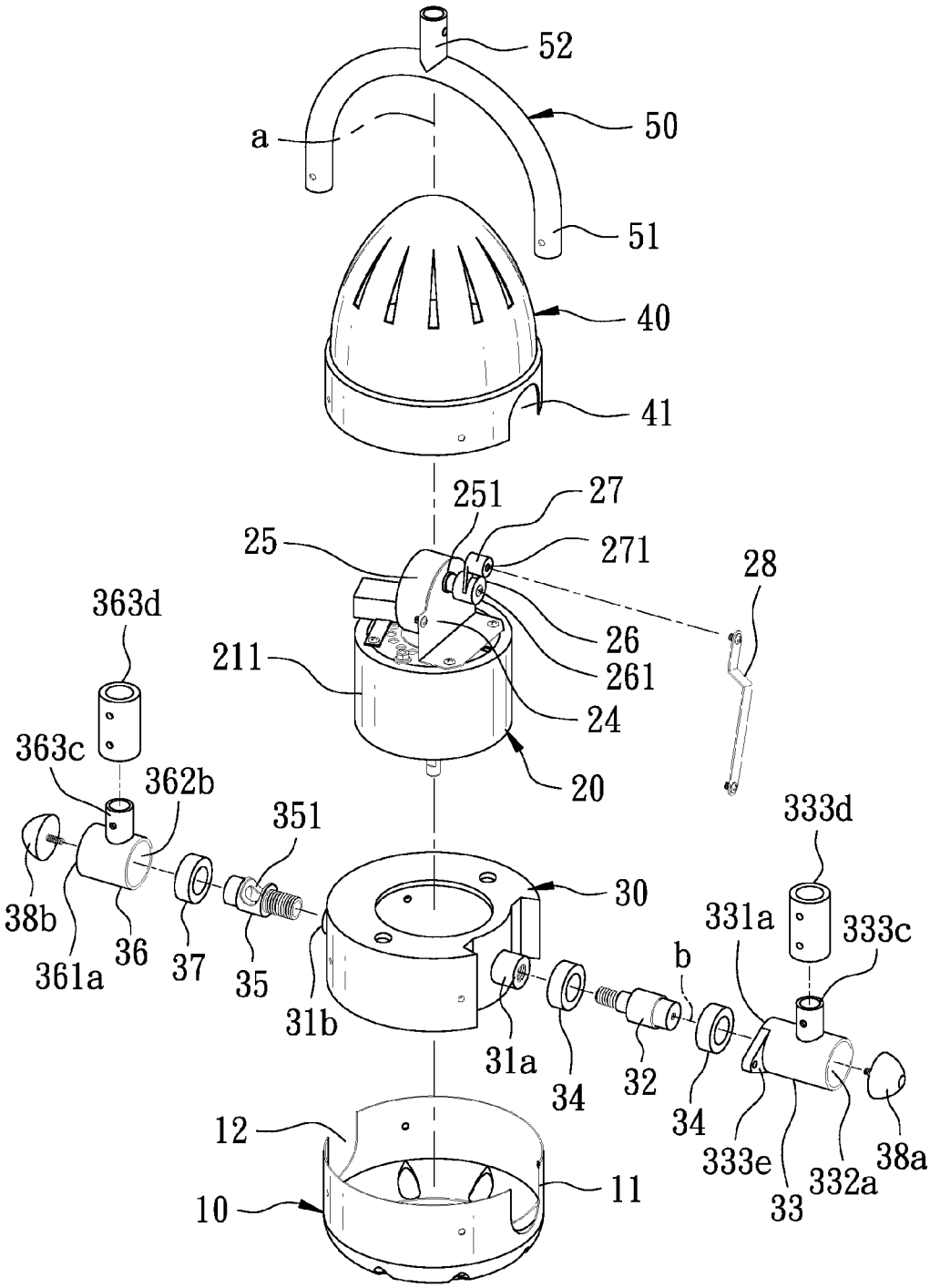
FIG. 2 is an exploded perspective view of the first preferred embodiment of the swing structure for a ceiling fan in the present invention.

The intermediate aluminum ring 30, referring to FIG. 2, is a hollow ring mounted around the outer circumference of the weight center of the swing mechanism 20. The intermediate aluminum ring 30 has its upper circumferential edge bent toward the upper circumferential edge of the outer casing 211 of the motor 21 to be fixed at the upper end of the outer casing 211. The intermediate aluminum ring 30 further has one end corresponding with a diametrical axis (b) and provided with a first protruding fixing opening 31*a* facing the first U-shaped notch 11 of the front cover base 10, and another opposite end disposed with a second protruding fixing opening 31*b* matching with the second U-shaped notch 12 of the front cover base 10. A swing spindle 32 has one end locked with the first fixing opening 31*a*, formed with an intermediate circumference larger than its opposite ends in its diameter. The swing spindle 32 is fitted thereon with a first inverted T-shaped three-way tube 33 having its left and right end respectively formed with two first horizontal end openings 331*a* and 332*a* communicating with each other to be fitted on the swing spindle 32 whose outer diameter is smaller than the inner diameter of the two first horizontal end openings 331*a*, 332*a*. A first vertical tube 333*c* communicating with the first horizontal end openings 331*a*, 332*a* and parallel to the axis (a) is fixed and extended up between the two first horizontal end openings 331*a* and 332*a* and positioned outside the intermediate aluminum ring 30. Further, the swing spindle 32 positioned in the first horizontal end openings 331*a*, 332*a* has the opposite ends of its intermediate portion respectively fitted thereon with a first bearing 34 having its outer diameter exactly tallying with the inner diameter of the first horizontal end openings 331*a*, 332*a* for resisting against the inner circumferential wall of the first horizontal end openings 331*a* and 332*a*. The first vertical tube 333*c* is fitted thereon with a first connecting tube 333*d*, and the first horizontal tube 331*a* has one side fixed with a triangular fixing projection 333*e* to be pivotally connected with the lower end of the connecting rod 28. The second fixing opening 31*b* is secured with one end of a hollow threading spindle 35 fitted thereon with a second inverted T-shaped three-way tube 36 and formed with an outer diameter smaller than the inner diameter of the second three-way tube 36. The second three-way tube 36 has its left and right end respectively formed with two second horizontal end openings 361*a* and 362*b* communicating with each other. A second vertical tube 363*c* communicating with the second horizontal end openings 361*a* and 362*b* and parallel to the axis (a) is disposed protruding up between the two second horizontal end openings 361*a* and 362*b* and positioned outside the intermediate aluminum ring 30. The threading spindle 35 positioned in the two second horizontal end openings 361*a* and 362*b* is fitted thereon with a second bearing 37 having its outer diameter exactly matching with the inner diameter of the second horizontal end openings 361*a* and 362*b* for resisting against the inner circumferential wall of the second horizontal end openings 361*a* and 362*b*. Further, the threading spindle 35 is bored with a threading opening 351 at a location corresponding with the second vertical tube 363*c*, and a second connecting tube 363*d* is fitted around the second vertical tube 363*c*. Furthermore, the first horizontal end opening 332*a* and the second horizontal end opening 361*a* are respectively covered with a first decorative cover 38*a* and a second decorative cover 38*b*.

The rear cover 40, referring to FIG. 2, is covered on the outer circumference of the swing mechanism 20 at the opposite end of the front cover 10 and has its lower outer circumference firmly combined with the inner circumference of the front cover 10. The rear cover 40 is shaped oval, having its opposite lower edges respectively bored with a first notch 41 with a downward opening for respectively matching with the first and the second U-shaped notch 11 and 12 of the front cover 10.

The hanging tube 50 is formed with two fixing tubes 51 respectively fitted and secured with the first connecting tube 333*d* and the second connecting tube 363*d* as well as with the first vertical tube 333*c* and the second vertical tube 363*c*. The two fixing tubes 51 have their inner ends connected together, letting the hanging tube 50 bent and formed as an invented U-shape, having its upper center formed integral with an upright tube 52 extending upward to be combined with a connecting tube 53 having its upper end secured with an arc-shaped disk support base 70 to be fixed on a ceiling for hanging the ceiling fan thereon, as shown in FIG. 1.

Referring to FIG. 3, the swing spindle 32 has its end functioning to carry out right and left swinging motion, while the threading spindle 35 has its interior employed for embedding an electric wire 80 therein. The upper end of the connecting rod 28, which is pivotally connected with the actuating wheel 27, forms a pivot swing point (c), while the lower end of the connecting rod 28, pivotally connected with the fixing end 333*e*, forms a stationary support point (d). By so designing, when the reduction motor 25 is rotated, about 3-5 rpm (revolutions per minute), the actuating wheel 27 will be driven to actuate the swing mechanism to swing bias.

Figure 4:
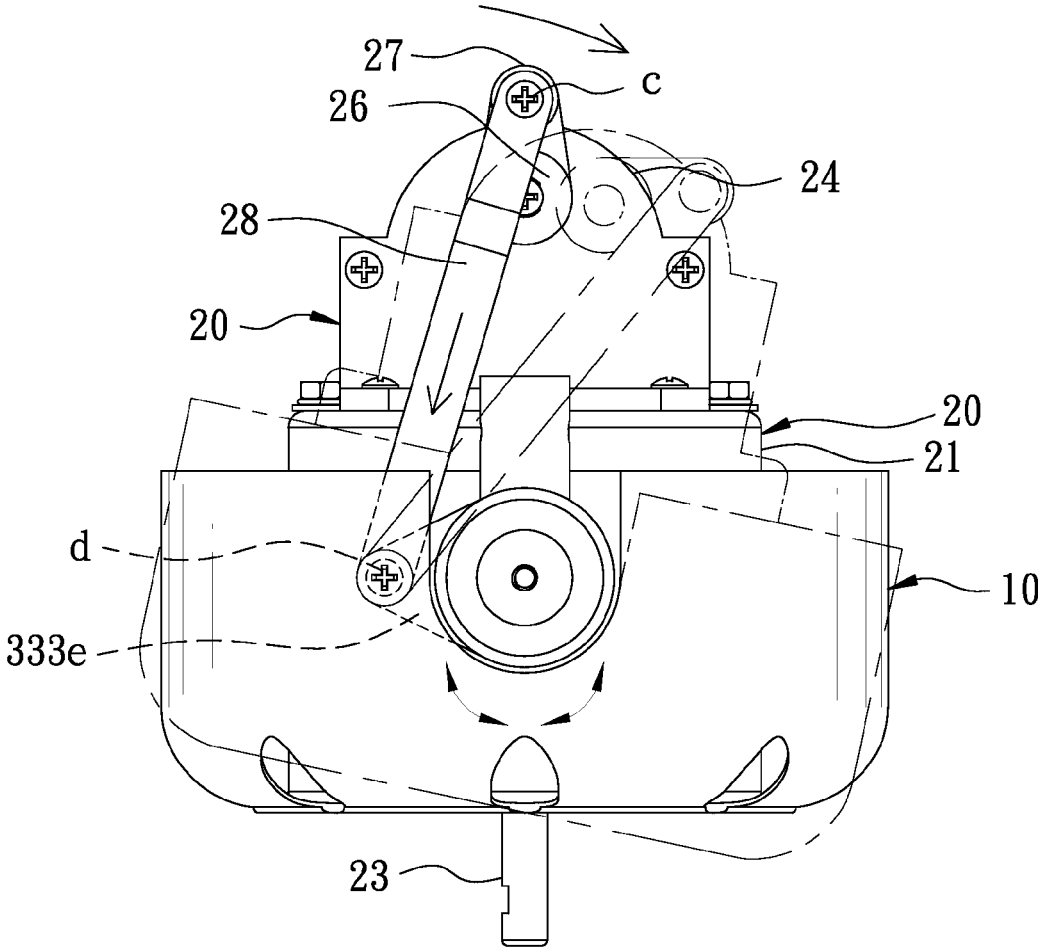
FIG. 4 is a side cross-sectional view of the first preferred embodiment of the swing structure for a ceiling fan in the present invention.

Referring to FIG. 4, when the actuating wheel 27 is driven by the reduction motor 25 to rotate along the driving wheel 26, the swing mechanism 20 with the axis (a) serving as a pivot will be actuated by the connecting rod 28 to swing rightward and leftward. When the reduction motor 25 is rotated in one direction for one round and returns to its starting point, the actuating wheel 27 will be driven to rotate along the driving wheel 26 and actuate the connecting rod 28 to shift up and down, and meanwhile the swing mechanism 20 together with the front cover 10 supported by the support point (D) will be actuated to swing bias upward to one side for 45 degrees. At this time, due to the gravity of the swing mechanism 20, the actuating wheel 27 and the swing mechanism 20 together with the front cover 10 will recover their original positions. Thus, the swing mechanism 20 can be actuated to swing bias repeatedly and also can smoothly recover its original position by means of the first bearing 34 and the second bearing 37. By so designing, the right and left swinging velocity of the ceiling fan can be controlled by adjusting the rotating velocity of the reduction motor 25. In addition, a remote controller can be used to facilitate controlling the operation of the reduction motor 25 as well as the swinging velocity of the ceiling fan for effectively carrying out ventilation and heat dissipation within a preset range in a room.

Figure 5:
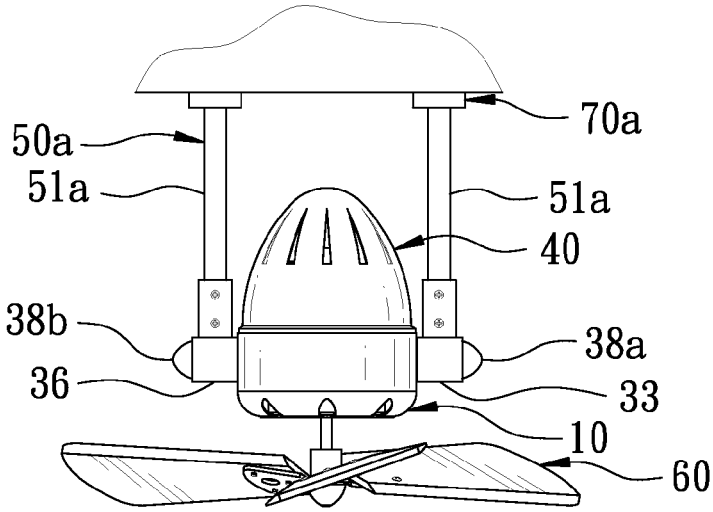
FIGS. 5(*a*) and 5(*b*) are respectively a front view and a side view of a second preferred embodiment of a swing structure for a ceiling fan in the present invention.
Figure 5:
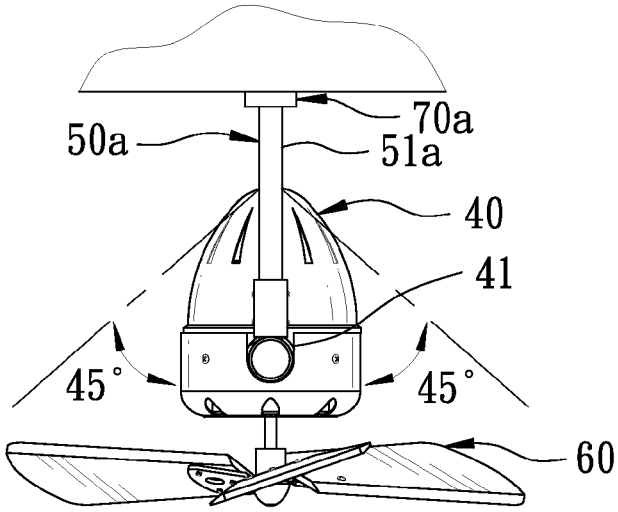

A second preferred embodiment of a swing structure for a ceiling fan in the present invention, as shown in FIG. 5, has almost the same structure and function as those described in the first preferred embodiment, except that the fixing tube 51*a* of the hanging tube 50*a* is an upright tube having its upper end fixed on the rectangular support base 70*a* that is firmly assembled on a ceiling for hanging an electric fan thereon.

Figure 6:
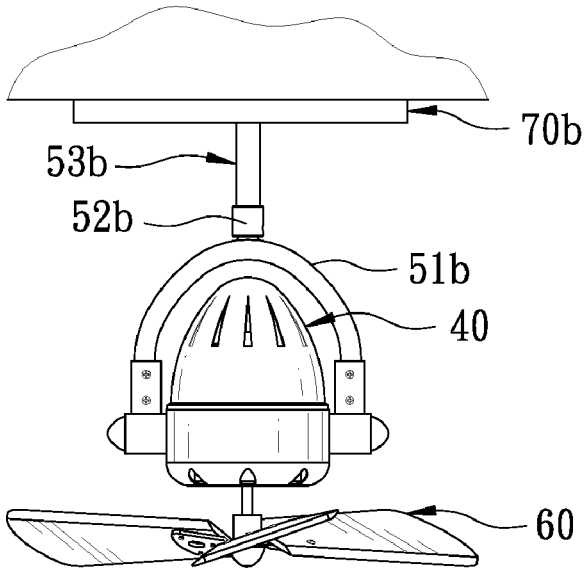
FIGS. 6(*a*) and 6(*b*) are side views of a third preferred embodiment of a swing structure for a ceiling fan in the present invention; and FIGS. (7*a*) and 7(*b*) are perspective views of a fourth preferred embodiment of a swing structure for a ceiling fan in the present invention.
Figure 6:
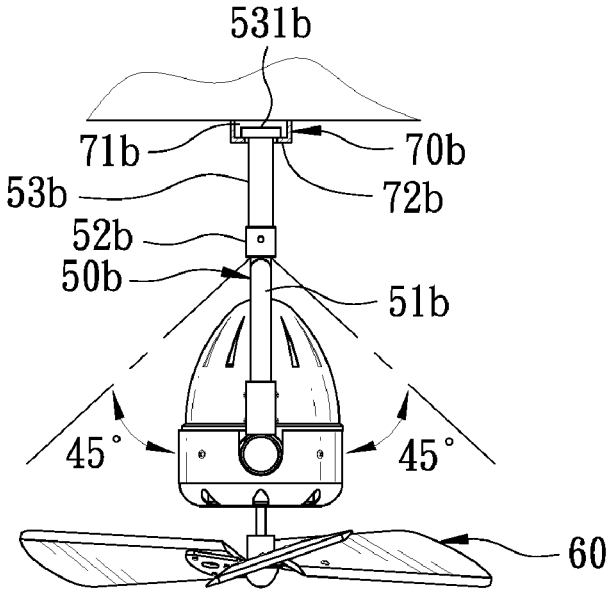

A third preferred embodiment of a swing structure for a ceiling fan in the present invention, as shown in FIG. 6, has almost the same structure and function as those described in the first preferred embodiment, except that the support base 70*b* is a long rectangular rail bored with a axial slide groove 71*b* with a downward opening and having its axial opposite sides respectively and horizontally disposed with a stop member 72*b* protruding toward the axis. The fixing tube 51*b* of the hanging tube 50*b* is integrally bent as an inverted U-shape, having its upper central portion formed integral with an upright combining tube 52*b* to be connected with a connecting tube 53*b*, which has its upper end fixed with a support block 531*b* to be inserted in the slide groove 71*b* from one short side for blocking the stop member 72*b*. The support block 531*b* is able to slide in the slide groove 71*b* and to be hung and arranged thereon with multiple-unit ceiling fan for elevating effect of heat dissipation.

Figure 7:
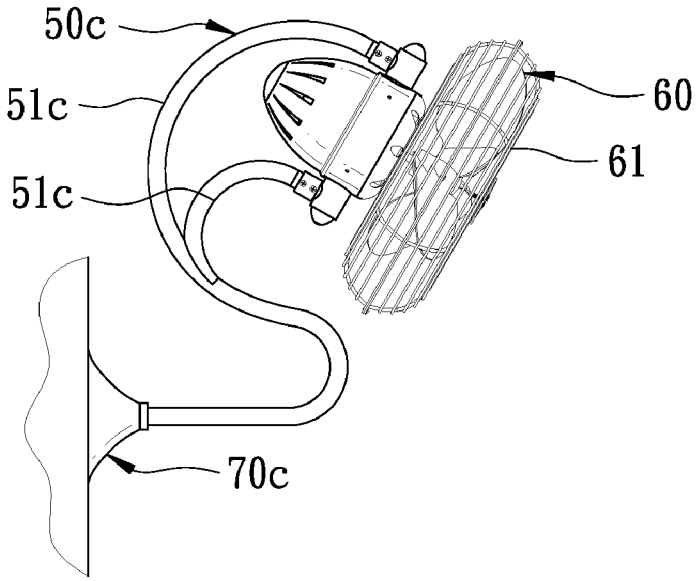
Figure 7:
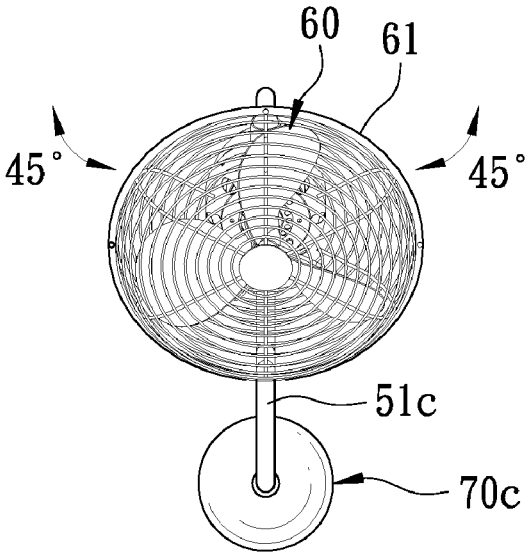

A fourth preferred embodiment of a swing structure for an electric fan in the present invention, as shown in FIG. 7, is almost the same as the first preferred embodiment in structure and function, except that the electric fan is hung on a comparatively lower sidewall. The fixing tubes 51*c* of the hanging tube 50*c* have their ends respectively fitted and secured in the first vertical tube 333*c* and the second vertical tube 363*c*, and the other ends bent downward and connected together and then having an intermediate portion extended downward and bent toward the wall to be secured on the support base 70*c* that is fixed on the wall. A protective frame 61 is fixed around the outer circumference of the fan blade 60 for preventing people from touching and getting hurt by the fan blade 60.

As can be understood from the above description, this invention has the following advantages.

1. The hanging tube is provided for supporting the opposite sides of the ceiling fan, letting the load of the ceiling fan imposed on the opposite sides.

2. The support base facilitates the electric fan to be hung at different locations of different angles and still enables the ceiling fan to swing rightward and left ward.

3. The swing spindle is positioned at one side of the ceiling fan, letting the rotation fulcrum of the ceiling fan set at one side, and the swing velocity of the ceiling fan is controlled by the reduction motor not by the fan motor; therefore, different rotating velocities of the fan motor will not affect the swing velocity of the ceiling fan, thus prolonging service life of the ceiling fan.

4. The threading spindle provided at another side of the ceiling fan functions to receive and hide the electric wire therein, able to maintain the external beauty of the ceiling fan.

While the preferred embodiments of the invention have been described above, it will be recognized and understood that various modifications may be made therein and the appended claims are intended to cover all such modifications that may fall within the spirit and scope of the invention.

I claim:

1. A swing structure for a ceiling fan comprising:

a front cover being shaped as a ring, said front cover having its opposite sides respectively cut with a first U-shaped notch and a second U-shaped notch;

a swing mechanism received in said front cover, said swing mechanism provided with a motor, said motor disposed with a main shaft at a location corresponding with a center of said front cover, said main shaft inserted through said front cover base to be pivotally assembled with a fan blade, said motor having its upper end fixed with a reduction motor, said reduction motor having one side pivotally fixed thereon with a driving wheel, said driving wheel pivotally connected axially with one end of a connecting rod;

an intermediate aluminum ring assembled on an outer circumference of a weight center of said swing mechanism, said intermediate aluminum ring having one end provided with a swing spindle at a location corresponding with said first U-shaped notch, said intermediate aluminum ring having another end fixed with a hollow threading spindle at a location tallying with said second U-shaped notch, said swing spindle fitted thereon with a first three-way tube, said first three-way tube having its opposite ends respectively formed with two first horizontal end openings communicating with each other, one of said first horizontal end openings disposed with a sidewise fixing projection pivotally combined with another end of said connecting rod, a first vertical tube provided extending up between said first horizontal end openings, said swing spindle in said first horizontal end openings fitted thereon with at least one first bearing, said threading spindle fitted thereon with a second three-way tube, said second three-way tube having its opposite ends respectively formed with a second horizontal end opening communicating with each other, a second vertical tube extended upward between said second horizontal end openings, said threading spindle in said second horizontal end openings having at least one second bearing fitted thereon, said threading spindle bored with a threading opening at a location matching with said second vertical tube;

a hanging tube formed with two fixing tubes respectively fitted and fixed in said first vertical tube and said second vertical tube, said two fixing tubes having their ends secured on at least one support base, said support base fixing said ceiling fan at a preset location; and said motor has its outer circumference assembled with an outer casing and said reduction motor is mounted on said outer casing, said outer casing having its lower end combined with said front cover, said intermediate aluminum ring having its upper circumferential edge bent toward an upper circumferential edge of said outer casing to be fixed on an upper end of said outer casing.

2. The swing structure for a ceiling fan as claimed in claim 1, wherein said swing mechanism has one end opposite to said front cover covered thereon with a decorative rear cover, said rear cover cut with two opposite notches respectively matching with said first U-shaped notch and said second U-shaped notch of said front cover.

3. The swing structure for a ceiling fan as claimed in claim 1, wherein said first horizontal end opening and said second horizontal end opening at opposite ends of said intermediate aluminum ring are respectively covered with a first decorative cover and a second decorative cover.

4. The swing structure for a ceiling fan as claimed in claim 1, wherein said two fixing tubes have their inner ends connected together to let said hanging tube bent and formed as an inverted U-shape, having its intermediate portion formed integral with an upright combining tube extending upward to be fixed on said support base that is secured on a ceiling.

5. The swing structure for a ceiling fan as claimed in claim 1, wherein said two fixing tubes are respectively fixed on two support bases that are secured on said ceiling.

6. The swing structure for a ceiling fan as claimed in claim 1, wherein said two fixing tubes have their inner ends connected together to let said hanging tube bent as an inverted U-shape, having its intermediate portion formed integral with an upright combining tube extending upward, said upright combining tube having another end combined with a connecting rod having another end fixed with a support block, said support base disposed with a long rectangular rail fixed on said ceiling, said long rectangular rail bored with an axial slide groove with a downward opening, said long rectangular rail having its opposite sides respectively provided with a stop member protruding horizontally toward a center, said support block inserted into said slide groove through one short side of said support base.

7. The swing structure for a ceiling fan as claimed in claim 1, wherein said fixing tubes of said hanging tube have one end respectively fitted fixedly in said first vertical tube and said second vertical tube and another end bent downward in a same direction to be connected together and having its central portion bent downward to one side and then extended transversely to be fixed on said support base that is secured on a side wall.

* * * * *